US006227389B1

(12) United States Patent
Merkel

(10) Patent No.: US 6,227,389 B1
(45) Date of Patent: May 8, 2001

(54) FLEXIBLE PARTITION PANEL ARRANGEMENT

(75) Inventor: Raimund Merkel, Gernsbach (DE)

(73) Assignee: KR-Porsiplast Verpackungssysteme GmbH, Muggensturm (DE)

( * ) Notice: Subject to any disclaimer, the term of this patent is extended or adjusted under 35 U.S.C. 154(b) by 0 days.

(21) Appl. No.: 09/503,924

(22) Filed: Feb. 14, 2000

(30) Foreign Application Priority Data

Feb. 15, 1999 (DE) ..... 299 02 518 U
Oct. 21, 1999 (DE) ..... 299 18 614 U

(51) Int. Cl.[7] ..... A47F 5/00
(52) U.S. Cl. ..... 211/184; 312/184; 206/383
(58) Field of Search ..... 211/41.1, 184; 312/183, 184; 206/583, 593; 220/530, 533, 534, 535, 549, 550

(56) References Cited

U.S. PATENT DOCUMENTS 2,174,201 * 9/1939 Chauvin .
4,527,694 * 7/1985 Bolt et al. .
4,685,571 * 8/1987 Hoss ..... 206/583
4,735,320 * 4/1988 Hoss ..... 206/583
5,086,920 * 2/1992 Binienda ..... 206/593 X
5,086,934 * 2/1992 Kelly ..... 211/45
5,211,290 * 5/1993 Janus et al. ..... 206/583
5,725,119 * 3/1998 Bradford et al. ..... 206/583 X
5,813,566 * 9/1998 Bradford et al. .
6,062,410 * 5/2000 Bradford et al. ..... 206/583 X

FOREIGN PATENT DOCUMENTS 1 192 581 5/1965 (DE) .
7 126 507 7/1971 (DE) .
44 32 195 4/1999 (DE) .
2 723 916 3/1996 (FR) .
2 114 544 8/1983 (GB) .

* cited by examiner

*Primary Examiner*—Robert W. Gibson, Jr.
(74) *Attorney, Agent, or Firm*—Collard & Roe, P.C.

(57) ABSTRACT

The invention concerns a flexible partition panel arrangement for stacking and shipping containers, shelves or the like, in connection with which the partition panels are arranged in the interior of the container or shelf. The flexible partition panel arrangement is characterized in that the partition panels are arranged on at least one board secured on a wall or on the ceiling.

9 Claims, 7 Drawing Sheets

FLEXIBLE PARTITION PANEL ARRANGEMENT

BACKGROUND OF THE INVENTION

1. Field of the Invention

The invention relates to a flexible partition panel arrangement for stacking and shipping containers, shelves or the like, where the partition panels are arranged in the interior of the container or shelf. More particularly, the invention relates to an arrangement in which the partition panels are arranged on at least one board secured on a wall, for example on the ceiling of the container.

2. The Prior Art

It is known to equip containers, shelf systems and other load-carrying devices with flexible vertical and horizontal partitions, which are directly or indirectly connected with the construction supporting the partitions.

A frequently employed method fits the parts forming the dividing construction with ears (or lugs) located in suitable sites. Bars or other suitable elements are then inserted through the ears, which in turn are secured on the outer construction.

Another used method secures on the dividing elements suitable applicators (or fasteners) such as, for example angles, loops or hooks. In this way, the dividing elements may be joined directly or indirectly with the outer contruction. Another possibility for installing flexible compartment dividers consists in riveting or screwing the dividing elements to the outer construction. A special type of stacking and shipping container equipped with flexible partition panels is employed for packaging and shipping linings for passenger car doors. In such containers, extruded strips (or welts) with a T-shaped cross section are attached to five vertical dividiers. The strips are then horizontally inserted in rails according to the principle employed in connection with rails for curtains. The rails have a C-shaped cross section and are secured in the interior of the container with rivets or screws. The container is produced from lightweight construction board or panels. This type of construction has the drawback that the "curtain rails" project into the drawer (or "slide-in") zone of the container, which poses the risk that the products, i.e. the door linings to be shipped, are damaged when they are pushed into the compartments. Furthermore, with this type of special construction, the size of the drawer or slide-in-zone is substantialy reduced by this type of fastening.

The known types of fastening for flexible dividers have the following drawbacks:

- Damage may be caused to the empty container when the compartments or packets are loaded.
- The arrangements consist of a great number of components.
- The fastening elements can be manufactured and mounted on the outer constructions only at high cost.
- Soiled or damaged fastening elements cannot be replaced at all, or only at high cost.

SUMMARY OF THE INVENTION

The present invention provides a flexible partition panel arrangement for stacking and shipping containers, shelves or the like, where the individual partition panels or compartment dividers are arranged spaced in any desired way between two walls, in particular between the bottom and the ceiling of a container. This partition panel arrangement excludes damage to the product received in the container. It can be secured on the support construction in a simple and economical way, leaving open a maximally sized opening for sliding in the partitions, whereby it is possible to remove the partition panel arrangement in a simple way for repair or cleaning purposes.

In accordance with the invention, a flexible partition panel arrangement of the type specified above is proposed wherein the partition panels are arranged on at least one board secured on a wall or on the ceiling.

According to another embodiment of the invention, two partition panels are connected with each other for forming compartments or pockets on the underside opposing the board. According to a preferred embodiment of the invention, at least two, preferably rectangular, boards are secured on opposite walls, in particular on the bottom and on the ceiling of the shipping container, with the flexible dividers being secured on the surfaces of the boards.

According to another embodiment of the invention, the boards have slots, through which the flexible dividers are inserted and then fixed on the slots.

In another embodiment, the dividers have loops which are inserted in the board slots and are retained by flat fastening bars located behind the boards. The boards then can be secured in the outer construction with just a few screws or rivets or other suitable fastening elements. If the compartment dividers are equipped with loops, fastening bars are inserted through the loops, so that the compartments are then non-positively connected with the boards Another possible embodiment of the invention consists in providing the ends of the flexible divider with angles, which means no other fastening elements are needed for locking the dividers on the board. Even very complex dividers can be simply and quickly secured in this way on support constructions.

According to yet another embodiment of the invention, the boards with the slots may have elevations or recesses for the purpose of permitting centering with other stacking containers or shelf parts. It is possible also to work recesses into the boards, into which the fastening means, for example lock nuts can be inserted for locking screws. The board may also be provided with bore holes for receiving fasteners, for example rivets or screws.

Important advantages are gained with the flexible partition panel arrangement as defined by the invention. For example, different types of flexible compartment dividers can be connected in a simple way with any desired types of outer construction such as, for example shipping or storage containers. Owing to the special arrangement, the opening for sliding in the products to be shipped is not reduced, which prevents such products from being damaged by fastening elements. The flexible compartment dividers can be installed and replaced in an optimally short time. Furthermore, centering and stacking means can be integrated in the fastening board in a simple way.

Another embodiment of the invention provides the fastening board or boards with a number of indentations or notches arranged spaced from each other. The loops provided on the partition panels are suspended on the protrusions of the fastening board or boards located between such indentations or notches.

This partition panel arrangement as defined by the invention, is advantageous because it permits the partition panels to be secured on the board or boards simply and safely.

The indentations or notches may be provided with a trapezoidal shape, so that projections are formed. The loops of the partition panels can then be pushed onto the projections. The diameter of the loops decreases from the back to the front in accordance with the shape of the projections. The front peaks of the projections may be provided with upwardly projecting elevations for the purpose of preventing the loops from slipping from the projections.

BRIEF DESCRIPTION OF THE DRAWINGS

Other objects and features of the present invention become apparent from the following detailed description considered in conjunction with the accompanying drawings which disclose an embodiment of the present invention. It should be understood, however, that the drawings are designed for the purpose of illustration only, not as a definition of the limits of the invention.

In the drawings, wherein similar reference characters denote similar elements throughout the several views.

DETAILED DESCRIPTION OF PREFERRED EMBODIMENTS

Figure 1:
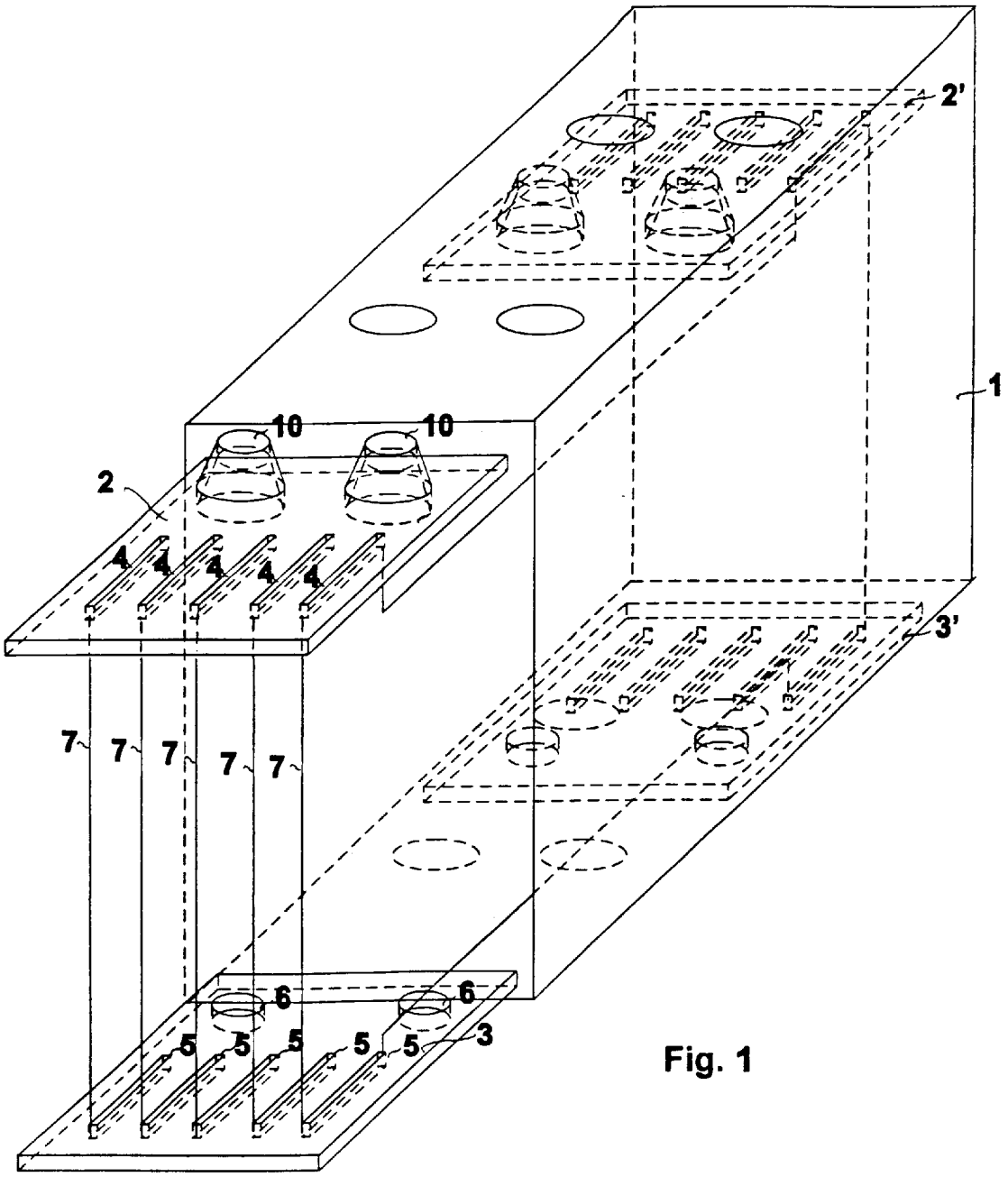
FIG. 1 is a perspective view of a flexible partition panel arrangement for a container, shown by a pulled-apart perspective representation.

As shown in the drawing, the flexible partition panel arrangement as defined by the invention is inserted in a stacking and shipping container 1 having any desired rectangular shape. The container is made of a plastic material, for example a cellular or honeycomb-type plastic. In this embodiment, the partition panel arrangement consists of the boards, 2, 3, 2', 3', respectively, which are provided with a plurality of longitudinally extending slots 4 and 5, respectively. The boards 3 and 3', respectively, have two larger bore holes 6 which, in cooperation with pegs 10 or screw capsules, permit centering of the boards in their installed condition.

According to a preferred embodiment, of the flexible partition panels 7—which are made of suitable textile materials or plastic—are inserted in the slots 4, 5 for forming receiving compartments or pockets. On the top side, the partition panels 7 have straps provided in such a way that the loops 8 are formed. The flat bars 9 are inserted through the loops. The individual flexible partition panels are in this way non-positively connected with the boards 2, 3, and 2', 3' respectively.

For inserting the partition panel arrangement in the shipping container 1, the boards 2, 3 and 2', 3', respectively, provided with the partition panels 7 are slid into the container 1, and centered by means of the bore holes 6 and the pegs 10 or screw capsules. For fastening purposes, the boards 2, 3 and 2', 3', respectively, can be additionally secured on the shipping container 1 with rivets or screws. Instead of using the loops 8, it is possible also to connect the ends of the flexible partitions or walls 7 with rigid angle elements 9', which then permit fastening of the flexible partitions once they have been inserted through the slots 4.

Furthermore, the boards 2, 3, and 2', 3', respectively, can be provided with elevations or recesses located in any desired position. Such elevations and recesses can then be used as a stacking or centering system for centering with other boards, stacking containers or shelf parts.

Figure 2:
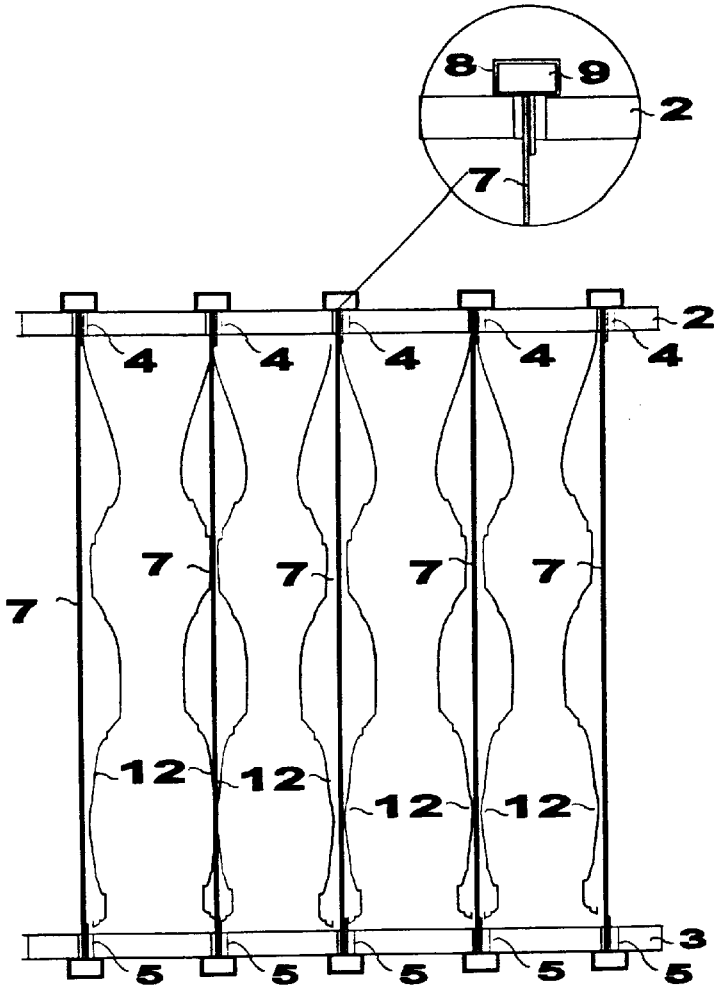
FIG. 2 shows a section through an embodiment of the flexible partition panel arrangement as defined by the invention.
Figure 3:
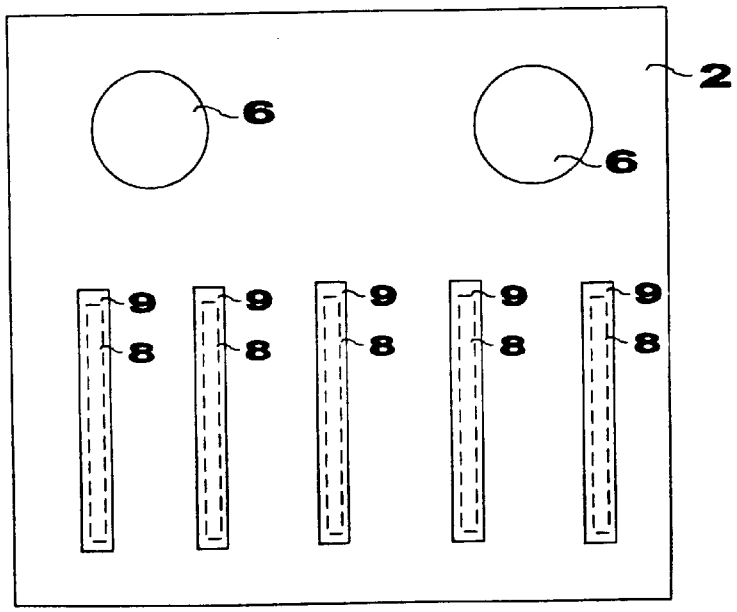
FIG. 3 is a top view of an embodiment of the partition panel arrangement as defined by the invention.
Figure 4:
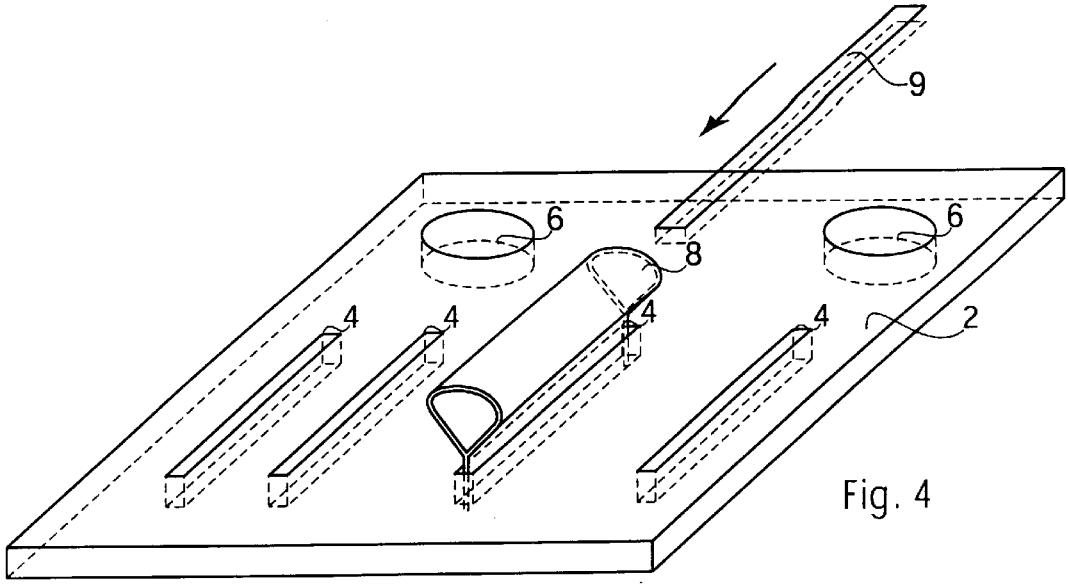
FIG. 4 shows a perspective view of a preferred embodiment according to FIG. 2, and a type of fastening of the partition panels using loops, shown by a pulled-apart perspective representation.
Figure 4A:
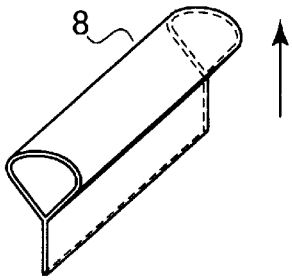
FIG. 4A is a partial view of a type of fastening of the partition panels using a rigid angle element connected to the partition panel or wall.
Figure 4A:
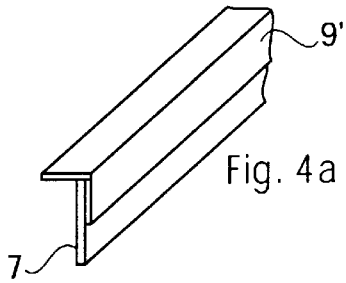

As shown in FIG. 2 parts shaped in any desired way, for example motor vehicle doors 12, can be slid or pushed into the individual compartments or pockets with the flexible partition panels. The panels adapt themselves to the contours of the doors.

Figure 5:
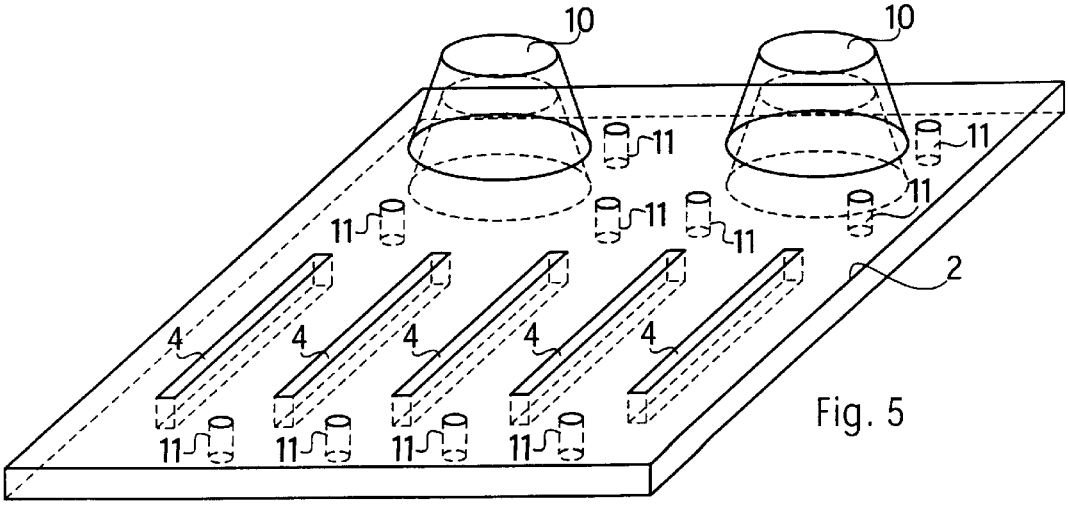
FIG. 5 shows a perspective view of a preferred embodiment with fastening bore holes and stacking pins.
Figure 6:
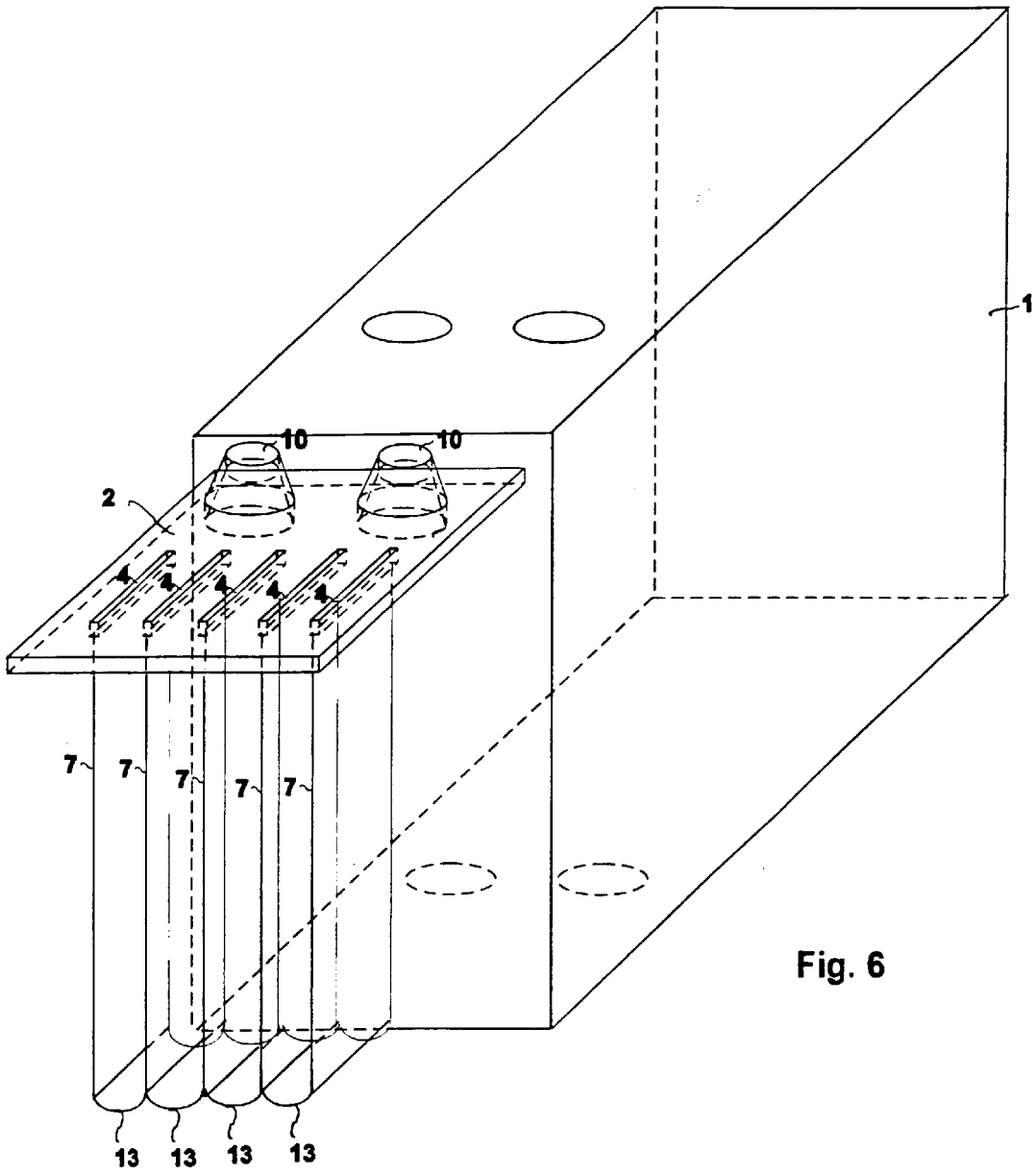
FIG. 6 shows a perspective view of flexible partition panel arrangement using only one or two boards disposed in a single plane.

FIG. 5 shows that recesses or bore holes 11 may be worked into boards 2, 3. Fastening means may be inserted into recesses 11 for securing the boards on the walls, the example on the bottom and on the ceiling of the container.

Figure 7:
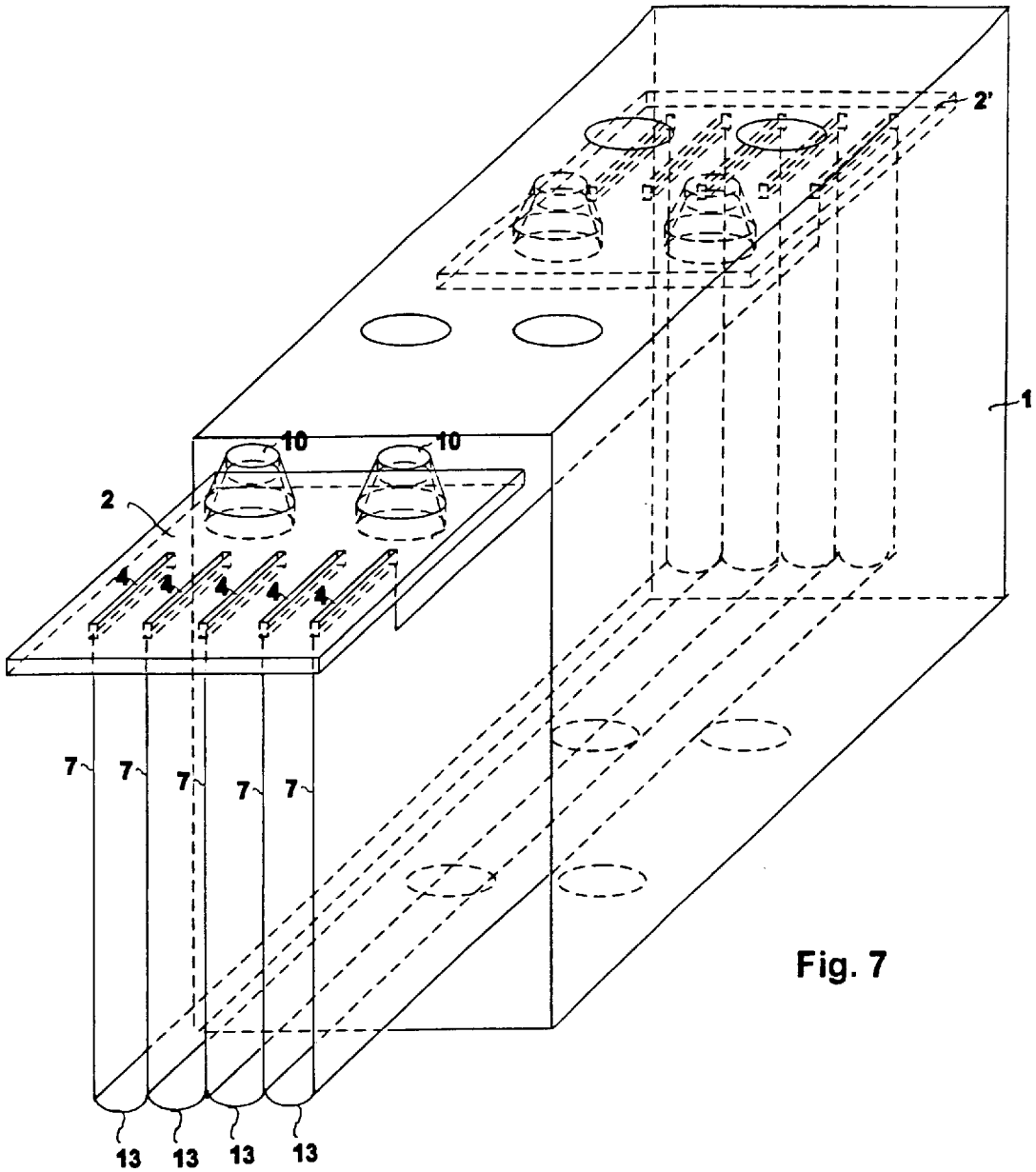
FIG. 7 shows a perspective view of a flexible partition panel arrangement in which two boards disposed in one plane are used.

FIG. 7 shows that provision is made for only two boards 2, 2' disposed in one plane. The flexible partition panels 7 are present in the slots 4 of the boards. As shown at 13 the partition panels are connected with each other on the underside for forming pockets. Of course, it is possible also to employ only one board 2.

Figure 8:
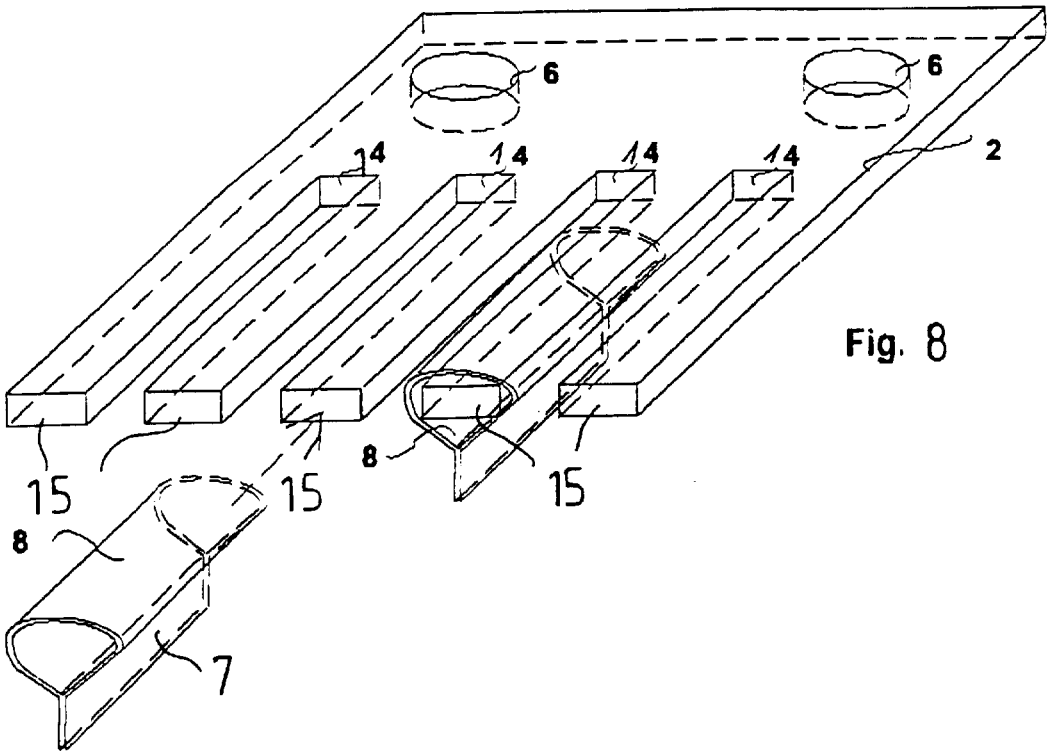
FIG. 8 shows another type of a fastening board.

As shown in FIG. 8, fastening board 2, which is arranged in the interior of a container or shelf, has indentations or notches 14 cut from the face side to form projections 15 in fastening board 2. For fastening the flexible partition panels 7, the loops 6 of the panels are mounted on projections 15. A simple and safe connection is produced in an easy way in this manner between the flexible partition panels 7 and the fastening boards 2, of which only one is shown, but which may be present also in the same arrangement on the opposite side. In cooperation with the pegs or screw capsules, bore holes 6 permit also in this case centering of the fastening boards 2 in their installed position, and securing of the flexible partition panel arrangement in the interior of the container or shelf. The fastening board, furthermore, may be provided with additional elevations and recesses.

Figure 9:
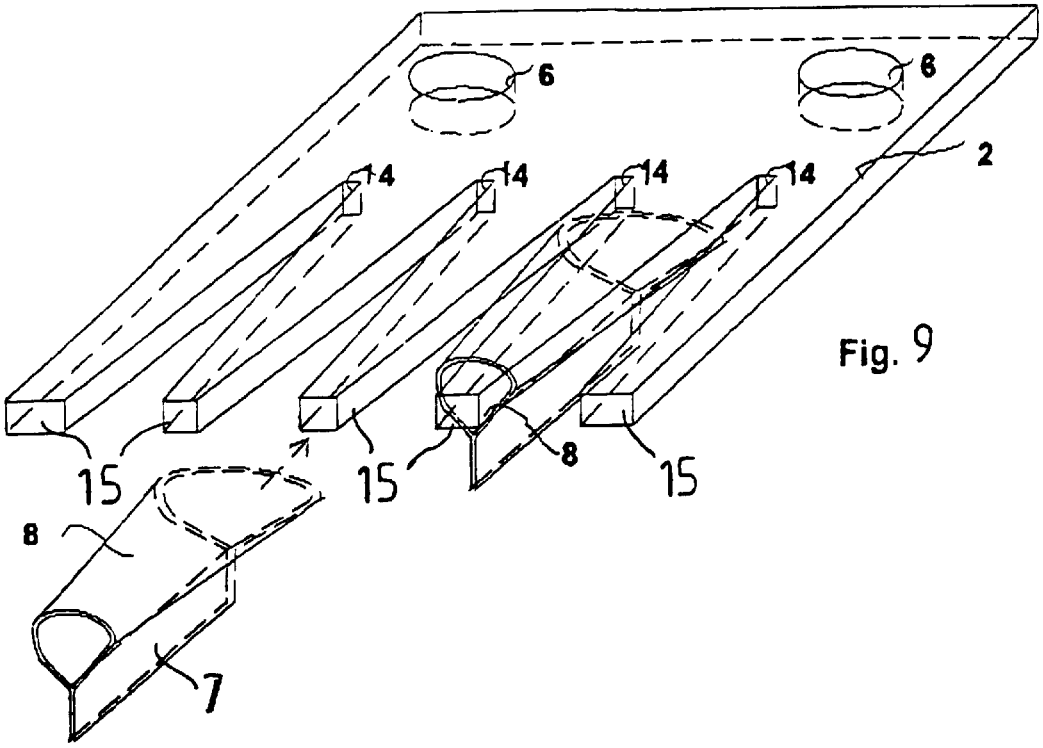
FIG. 9 shows a modified design of the fastening board according to FIG. 8.

FIG. 9 shows another embodiment of the fastening board 2 as defined by the invention. In this embodiment, indentations or notches 14 have the shape of a trapezoid, so that projections 15 are formed. The loops 8 of partition panels 7 are pushed onto projections 15. The diameter of loops 8 decreases from the back to the front in accordance with the shape of the projections.

Figure 10:
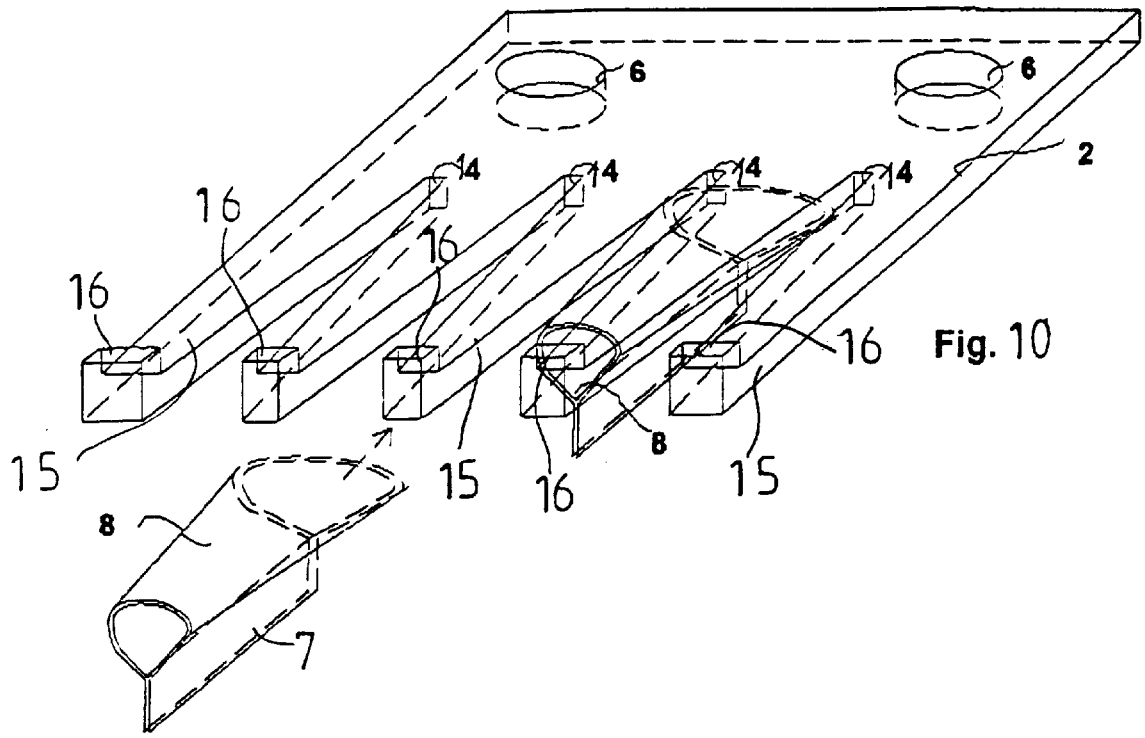
FIG. 10 shows a modified design of the fastening board according to FIG. 9.

FIG. 10 shows a modified embodiment of the board according to FIG. 9, where the front ends of projections 15 have elevations 16 protruding upwardly. The elevations prevent loops 8 from slipping from projections 15.

While several embodiments of the present invention have been shown and described, it is to be understood that may changes and modifications may be made thereunto. Without departing from the spirit and scope of the invention as defined in the appended claims.

What is claimed is:

1. A flexible partition panel arrangement for a load-carrying structure having an interior and at least one supporting wall comprising:

(a) at least one board adapted to be secured on the supporting wall, and (b) a plurality of partition panels arranged on said board and adapted to be located in the interior of the load-carrying structure when said board is secured on the supporting wall, wherein said partition panels have a first side arranged on the board and a second side away from said board and two partition panels are connected with each other on the second side to form a compartment.

2. A flexible partition panel arrangement for a container having an interior, a ceiling, and a bottom comprising:

(a) at least two rectangular boards adapted to be secured on the bottom and on the ceiling of the container;

(b) a plurality of partition panels arranged on each board and adapted to be located in the interior of the container when said boards are secured on the bottom and on the ceiling of the container, each partition panel being secured and arranged with any desired spacing to form compartment dividers;

wherein the boards have a plurality of slots through which the partition panels are inserted and on which said panels are fastened.

3. The flexible partition panel arrangement according to claim 2 wherein:

(a) each of said partition panels have at least one end provided with a loop;

(b) said ends are inserted in the slots; and (c) said arrangement further comprises a plurality of flat fastening bars, each of said bars being inserted in a corresponding one of said loops behind the boards.

4. The flexible partition panel arrangement according to claim 2 wherein:

(a) each of said compartment dividers have at least one end provided with a rigid angle piece; and (b) said rigid angle pieces are inserted in the slots of the boards for fixing on the supporting walls.

5. The flexible partition panel arrangement according to claim 1 wherein four boards are adapted to be secured on the at least one supporting wall, said boards being provided with a plurality of slots and with a plurality of centering elements selected from the group consisting of elevations, recesses, and combinations thereof.

6. A flexible partition panel arrangement for a load-carrying structure having an interior and at least one supporting wall comprising:

(a) at least one fastening board adapted to be secured on the supporting wall;

(b) a plurality of flexible partition panels arranged on said at least one fastening board, each of said flexible partition panels having a loop on an end of said panel for fixing the partition panel on said at least one fastening board;

(c) wherein said at least one fastening board has a plurality of spaced elements selected from the group consisting of indentations and notches, said spaced elements being spaced from each other to form a plurality of projections between the spaced elements; and (d) wherein said loops are mounted on the projections.

7. The flexible partition panel arrangement according to claim 6, wherein the spaced elements taper in a rearward direction, so that the spaced elements have an increasing opening toward the front, and the loops of the partition panels have a decreasing cross-section corresponding with the shape of the projections.

8. The flexible partition panel arrangement according to claim 7, wherein the projections have front peaks provided with protruding elevations to prevent the loops from slipping from the projections.

9. The flexible partition panel arrangement according to claim 1 wherein:

(a) the load-carrying structure is a container having a ceiling and a bottom;

(b) at least two boards are adapted to be secured on the bottom and on the ceiling of the container; and (c) said boards have a plurality of bore holes adapted to receive fastening means for securing the boards on the bottom and on the ceiling of the container.

* * * * *